US008562179B2

(12) United States Patent
Li et al.

(10) Patent No.: US 8,562,179 B2
(45) Date of Patent: Oct. 22, 2013

(54) LAMP WITH FAN AND HEAT SINK INSIDE

(75) Inventors: Ming-Tsung Li, Kaohsiung (TW); I-Le Fang, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 216 days.

(21) Appl. No.: 13/031,960

(22) Filed: Feb. 22, 2011

(65) Prior Publication Data

US 2012/0146481 A1 Jun. 14, 2012

(30) Foreign Application Priority Data

Dec. 13, 2010 (TW) ..... 99143580 A

(51) Int. Cl.
*F21V 29/02* (2006.01)

(52) U.S. Cl.
USPC ..... 362/294; 362/800; 313/46

(58) Field of Classification Search
None
See application file for complete search history.

(56) References Cited

U.S. PATENT DOCUMENTS 5,420,769 A 5/1995 Ahlgren et al.
7,144,135 B2 12/2006 Martin et al.
7,244,058 B2 7/2007 DiPenti et al.
7,575,346 B1 8/2009 Horng et al.
7,828,445 B2 11/2010 Sun
2009/0059559 A1* 3/2009 Pabst et al. ..... 362/84
2010/0165632 A1* 7/2010 Liang ..... 362/294

FOREIGN PATENT DOCUMENTS

CN 201636593 11/2010
JP 2010153198 7/2010
TW M346745 12/2008

* cited by examiner

*Primary Examiner* — Anh Mai
*Assistant Examiner* — Britt D Hanley
(74) *Attorney, Agent, or Firm* — Muncy, Geissler, Olds & Lowe, PLLC

(57) ABSTRACT

A fan comprises a housing, a fan, a heat sink, and a light emitting element. The housing has a compartment and forms an opening. The fan is mounted inside the compartment of the housing and has a frame and an impeller mounted inside the frame. A first air-guiding channel is formed between a peripheral surface of the frame and an inner peripheral surface of the housing. The heat sink is coupled to the fan and has a first surface and a second surface, with the first surface facing the impeller. Also, a second air-guiding channel is formed between an outer periphery of the heat sink and an inner surface of the frame. The light-emitting element is disposed on the second surface of the heat sink. In such arrangement, used components and structural complexity of the lamp can be significantly reduced so as to be convenient in assemblage.

10 Claims, 10 Drawing Sheets

LAMP WITH FAN AND HEAT SINK INSIDE

BACKGROUND OF THE INVENTION

1. Field of the Invention

The present invention relates to a lamp and, more particularly, to a lamp utilizing a fan to trigger air flow for heat-dissipation, and capable of indoor or outdoor illumination.

2. Description of the Related Art

In accordance with FIG. 1, a conventional lamp disclosed in the U.S. Pat. No. 7,575,346 and entitled "LAMP" comprises a housing 81, a heat sink 82, a light emitting element 83 and a cooling fan 84. The housing 81 has a first case 811 and a second case 812, and the first case 811 has an air outlet portion 811*a* and a transparent portion 811*b*, and the second case 812 has an air inlet portion 812*a*. The heat sink 82, the light emitting element 83 and the cooling fan 84 are all disposed inside the housing 81, with the heat sink 82 formed between the light emitting element 83 and the cooling fan 84, and with the light emitting element 83 facing the transparent portion 811*b*. With this arrangement, when the cooling fan 84 is in operation, air can be inhaled from the air inlet portion 812*a*, pass through the heat sink 82 and be exhaled from the air outlet portion 811*a* for dissipating heat generated by the light emitting element 83.

However, the housing 81 of the conventional lamp formed by the first case 811 and the second case 812 not only increases the number of used components but also complicates the whole structure of the conventional lamp. Furthermore, because the heat sink 82, the light emitting element 83 and the cooling fan 84 are all disposed inside the housing 81, it is necessary to piercingly form a plurality of vents for the air inlet and outlet portions 812*a* and 811*a* in the housing 81, which leads to the disadvantage of inconvenience in mass production.

Additionally, when the conventional lamp is inserted into a false ceiling that is distant from the ceiling with a sealed compartment defined between these two ceilings, the air inlet portion 812*a* and the air outlet portion 811*a* are settled right above the top surface of the false ceiling for artistic considerations, and only the transparent portion 83 remains beneath the false ceiling. However, since the sealed compartment above the false ceiling forms an enclosed space with poor air circulation, it results in poor heat dissipation. As a result, it is difficult to dispel heat and thus service life of the lamp is reduced.

Taiwan Patent No. M346745 entitled "LED LAMP" discloses another conventional lamp as shown in FIG. 2. Referring to FIG. 2, the lamp comprises a housing 91, a heat sink 92, a fan 93 and a LED assembly 94. The housing 91 has an upper case 911 and a lower case 912, and the upper case 911 has a plurality of vents 911*a* and the lower case 912 has a through-hole 921*a*. The heat sink 92 is disposed inside the housing 91, with a ventilation channel 95 linking the heat sink 92 and the through-hole 912*a* of the lower case 912. The fan 93 is also disposed inside the housing 91 and mounts to the heat sink 92. Also, the LED assembly 94 mounts to the heat sink 92 and is exposed to the outside via the through-hole 912*a*. When the cooling fan 93 is operated, the external air can be inhaled via the vents 911*a*, pass through the ventilation channel 95 and then be exhaled via the through-holes 912*a* for dissipating heat energy generated by the LED assembly 94.

However, the housing 91 of the above conventional lamp is also formed by two assembled cases, the upper case 911 and the lower case 912, and suffers the same disadvantages of structural complexity. Meanwhile, even if the ventilation channel 95 is formed between the heat sink 92 and the through-hole 912*a*, the upper case 911 still has to arrange the plural vents 911*a*. It is suggested that the conventional structure is still inconvenient in manufacture. Furthermore, although the through-holes 912*a* are made in contact with the external air when the conventional lamp is inserted into the false ceiling, the improvement in cooling efficiency of the lamp is still limited since the vents 911*a* are still located in the sealed compartment right above the top surface of the false ceiling. Hence, poor dispelling of heat and air circulation are still concerns in the conventional lamp and it is not enough to efficiently extend the service life of the lamp.

SUMMARY OF THE INVENTION

The primary objective of this invention is to provide a lamp with a first air-guiding channel and a second air-guiding channel separately formed between a housing and a heat sink of the fan, so that any additional air inlets or air outlets are no longer needed in the housing of the lamp.

The secondary objective of this invention is to provide a lamp whose first air-guiding channel and second air-guiding channel will not be blocked when it is in a form of an inbuilt lamp.

A lamp comprises a housing, having a compartment with an opening; a fan, disposed inside the compartment of the housing, and having an impeller mounted inside a frame, with a first air-guiding channel formed between a peripheral surface of the frame and an inner peripheral surface of the housing; a heat sink, coupled to the fan and having a first surface and a second surface, with the first surface facing the impeller and with an outer periphery of the heat sink being spaced from an inner peripheral surface of the frame to form a second air-guiding channel; and a light emitting element, disposed on the second surface of the heat sink.

Further scope of the applicability of the present invention will become apparent from the detailed description given hereinafter. However, it should be understood that the detailed description and specific examples, while indicating preferable embodiments of the invention, are given by way of illustration only, since various others will become apparent from this detailed description to those skilled in the art.

BRIEF DESCRIPTION OF THE DRAWINGS

The present invention will become more fully understood from the detailed description given herein below and the accompanying drawings which are given by way of illustration only, and thus are not limitative of the present invention, and wherein.

Figure 1:
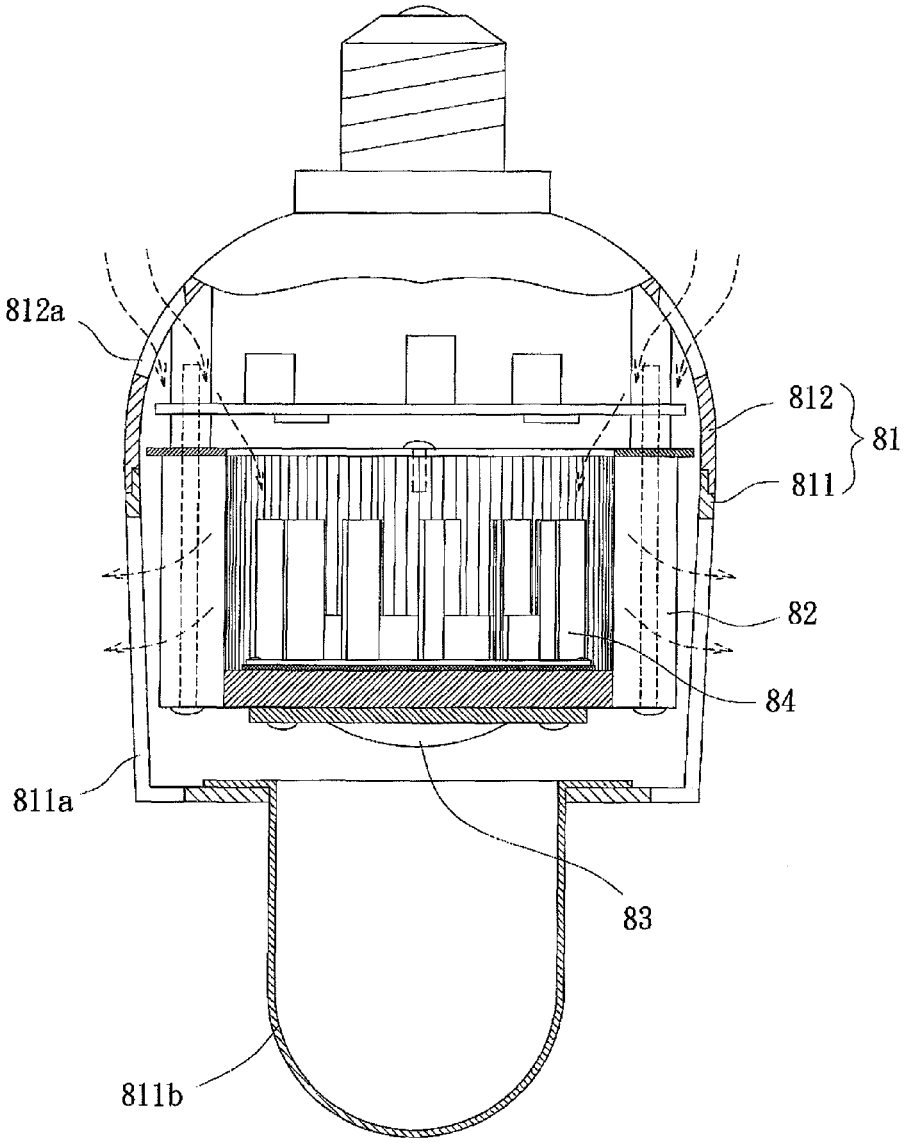
FIG. 1 PRIOR ART
FIG. 1 is a cross-sectional view illustrating a conventional lamp disclosed in U.S. Pat. No. 7,575,346.
Figure 2:
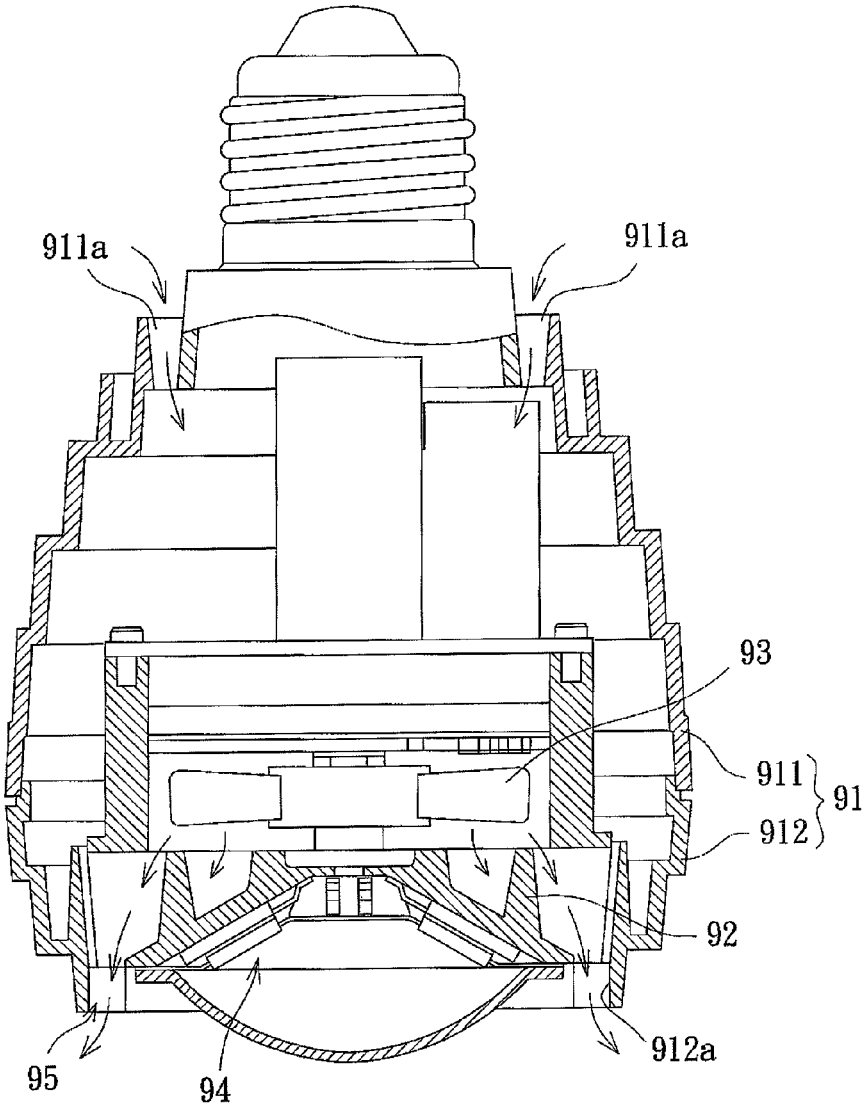
FIG. 2 PRIOR ART
FIG. 2 is a cross-sectional view illustrating another conventional lamp disclosed in Taiwan Patent No. M346745.

All figures are drawn for ease of explaining the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions conforming to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inner", "end", "portion", "section", "top", "bottom", "axial", "radial", "spacing", and similar terms are used herein, it should be understood that these terms refer only to the structure shown in the drawings as it would appear to a person viewing the drawings, and are utilized only to facilitate describing the invention.

DETAILED DESCRIPTION OF THE INVENTION

Figure 3:
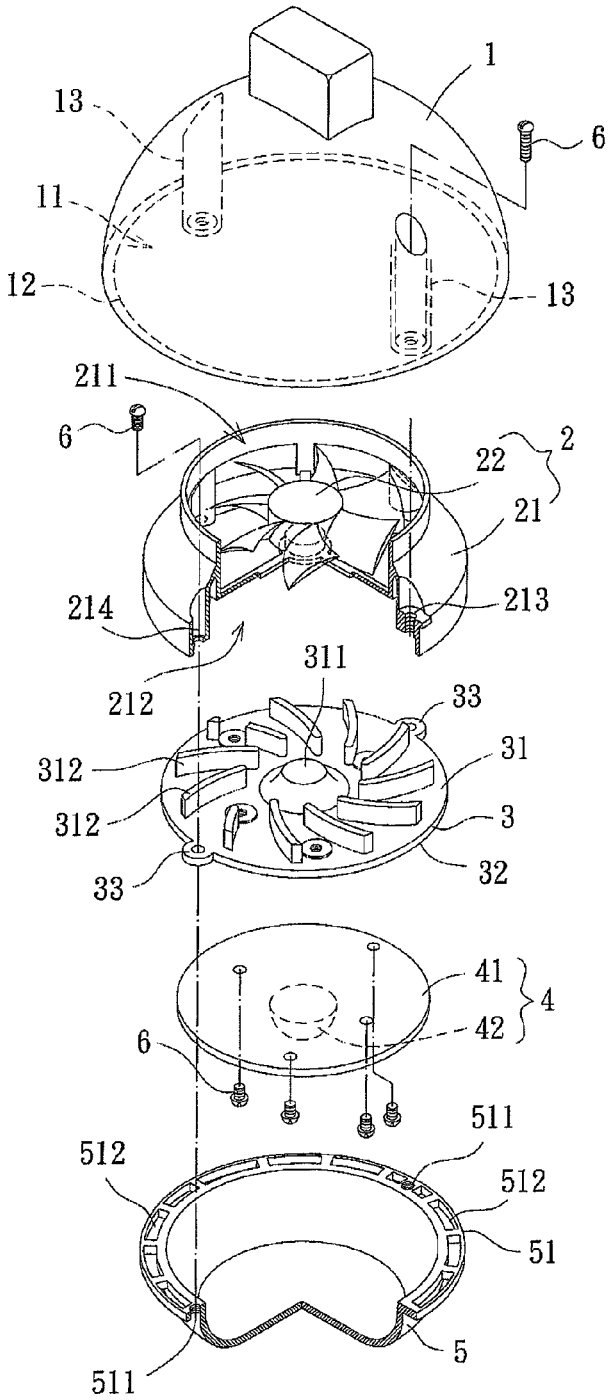
FIG. 3 is an exploded perspective illustrating a lamp in accordance with a first embodiment of the present invention.
Figure 4:
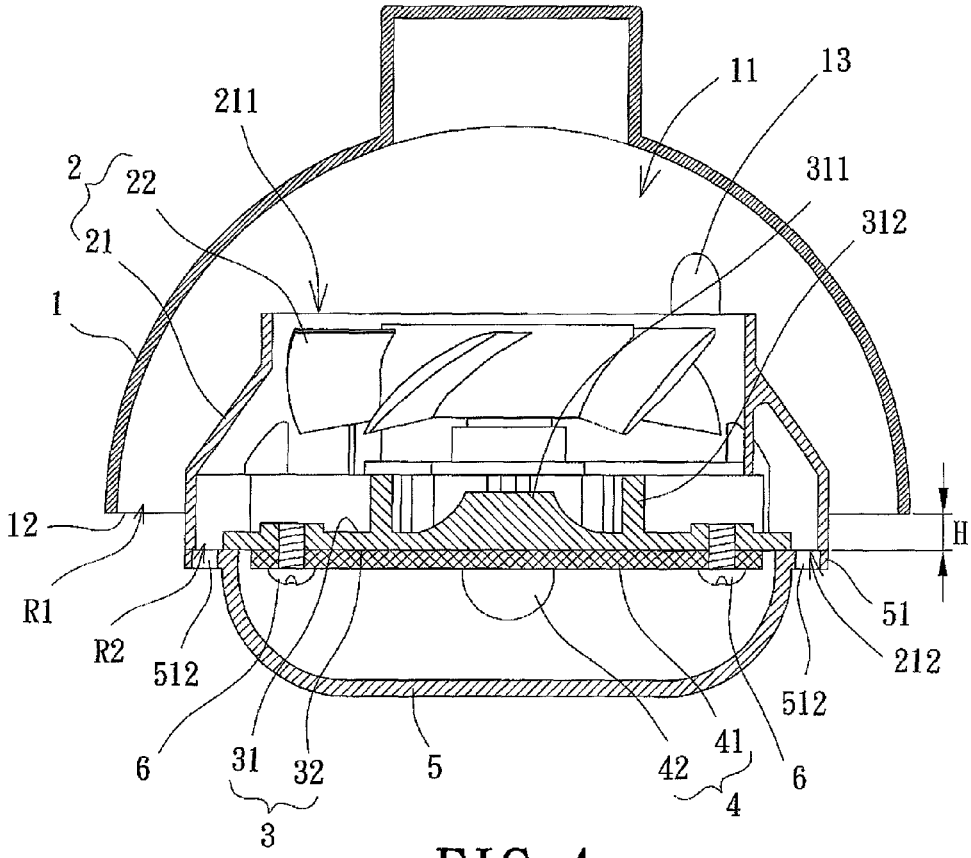
FIG. 4 shows a cross-sectional view of the lamp in accordance with the first embodiment of the present invention.

A lamp of a first embodiment in the present invention is shown in FIGS. 3 and 4, and comprises a housing 1, a fan 2, a heat sink 3 and a light emitting element 4, wherein all of the fan 2, the heat sink 3 and the light, emitting element 4 are received in the housing 1. The housing 1 has a compartment 11 with an opening 12 formed at an end thereof. Moreover, an inner peripheral surface of the housing 1 can further have a plurality of supporting elements 13. Each of the supporting elements 13 can be a rib, a supporting shaft or anything in the form of a protruding pillar, block or slice.

The fan 2 has a frame 21 and an impeller 22. The frame 21 comprises a first air passage 211 and a second air passage 212 that communicate with each other. The impeller 22 is disposed inside the frame 21 and between the first air passage 211 and the second air passage 212. With such arrangement, air can be inhaled from one of the first and second air passages 211, 212 and then exhaled by the other one of them, wherein the direction of air-circulation goes according to the rotated direction of the impeller 22.

The fan 2 is disposed inside the compartment 11 of the housing 1, and a peripheral surface of the frame 21 is spaced from an inner peripheral surface of the housing 1 to form a first air-guiding channel R1 for air to flow in or out. Accordingly, air in the compartment 11 can communicate with air outside the housing 1 via the first air-guiding channel R1. In this embodiment, the frame 21 extends from the compartment 11 of the housing 1 to the outer of the housing 1 through the opening 12 for the first air passage 211 to be disposed inside the compartment 11 but the second air passage 212 arranged out of the housing 1. Specifically, there is a longitudinal distance H between the second air passage 212 and the opening 12 of the housing 1, provided by the protrusive section of the frame 21 extending over the opening 12, and thus air turbulence caused by the interworking of inhaled and exhaled air is avoided. The frame 21 can further comprise a plurality of first assembled portions 213 and second assembled portions 214, with each of the first assembled portions 213 aligned with each supporting element 13 so that the housing 1 and the frame 21 can be coupled together by fixed elements 6. Furthermore, because of the supporting elements 13 in the form of a protruding pillar, block or slice, the supporting elements 13 can support and stand between the inner peripheral surface of the housing 1 and the peripheral surface of the frame 21 to delimit the first air-guiding channel R1.

The heat sink 3 can be any possible structure able to couple to the fan 2. According to the embodiment shown in FIGS. 3 and 4, the heat sink 3 in circular shape is used as an example. The heat sink 3 has a first surface 31 facing the impeller 22 and a second surface 32 opposite to the first surface 31. An outer periphery of the heat sink 3, which links the first and second surfaces 31, 32, is spaced from an inner peripheral surface of the frame 21 to form a second air-guiding channel R2 for air to flow in or out, with the compartment 11 also communicating with the outer of the housing 1 via the second air-guiding channel R2. Besides, functions of the first and second air-guiding channel R1, R2 are matched for air to be driven and flow through the first air-guiding channel R1, the compartment 11, and the second air-guiding channel R2 sequentially or through the second air-guiding channel R2, the compartment 11, and the first air-guiding channel R1 sequentially. In this embodiment, the heat sink 3 is mounted across the second air passage 212 of the frame 21. The first surface 31 may further have a protrusion 311 and a plurality of cooling fins 312 in order to increase the heat-dissipation area of the heat sink 3. Moreover, the outer periphery of the heat sink 3 further has a plurality of protruding fixed portions 33. Each of the fixed portions 33 can be any possible structural design capable of coupling with the second assembled portion 214 of the frame 21. In this embodiment, structure of the fixed portions 33 is in a shape of a lug, with each fixed portion 33 aligning with the second assembled portion 214 of the frame 21. Furthermore, the heat sink 3 can couple to the frame 21 by the fixed elements 6.

The light emitting element 4 is disposed on the second surface 32 of the heat sink 3. In this embodiment, the light emitting element 4 has a base plate 41 with a plurality of luminaries 42. Preferably, the luminaries 42 are of light-emitting diodes and the base plate 41 is disposed and fixed on the second surface 32 by the fixed elements 6.

The lamp of the first embodiment of the present invention can further comprise a cover 5 made of a light-transparent material that covers the light emitting element 4. Also, the cover 5 can be mounted and fixed to the second surface 32 of the heat sink 3 via methods of binding, screwed fixing, and buckling etc. In the present embodiment, a peripheral edge 51 of the cover 5 has an assembling hole 511 in alignment with the fixed portion 33 of the heat sink 3 so that the fixed element 6 can pass through the assembling hole 511 and the fixed portion 33 to combine the cover 5, the frame 21 and the heat sink 3. In addition, the peripheral edge 51 has a plurality of vents 512 for air circulation in correspondence with the second air-guiding channel R2.

In practical use of the lamp of the first embodiment in the present invention, the housing 1 can be settled right above the false ceiling with only the opening 12 beneath the bottom surface of the false ceiling. When the impeller 22 of the fan 2 rotates, air can be inhaled from one of the first and second air-guiding channels R1, R2 to the compartment 11, and exhaled by the other one of these two air-guiding channels R1, R2 for driving out heat generated by the light emitting element 4. With this arrangement, the direction of air-circulation can be controlled according to the rotating direction of the impeller 22. Specifically, when the impeller 22 rotates in a first direction, air can be inhaled from the first air-guiding channel R1 to the compartment 11, pass through the frame 21 and be exhaled by the second air-guiding channel R2. Yet, when the impeller 22 rotates in a second direction, air can be inhaled from the second air-guiding channel R2 to the compartment 11, pass through the frame 21 and be exhaled by the first air-guiding channel R1, in order to dissipate heat generated by the light emitting element 4.

In the present invention, the first air-guiding channel R1 is formed between the inner peripheral surface of the housing 1 and the peripheral surface of the frame 21, and the second air-guiding channel R2 is formed between the inner peripheral surface of the frame 21 and the outer periphery of the heat sink 3, with the first and the second air-guiding channels R1, R2 communicating with the compartment 11, so that air in the compartment 11 and air outside the housing 1 can circulate with each other via the first and the second air-guiding channels R1, R2. Accordingly, additional air inlets or air outlets in the housing 1 are not needed so as to facilitate the convenience of the manufacture of the lamp. Also, when this lamp coupled with the false ceiling, ends of the first and second air-guiding channels R1, R2 away from the fan 2 are all beneath the bottom surface of the ceiling for smooth air-circulation with air outside. Therefore, efficiency of heat dissipation is significantly promoted in any direction of air-circulation.

Figure 5:
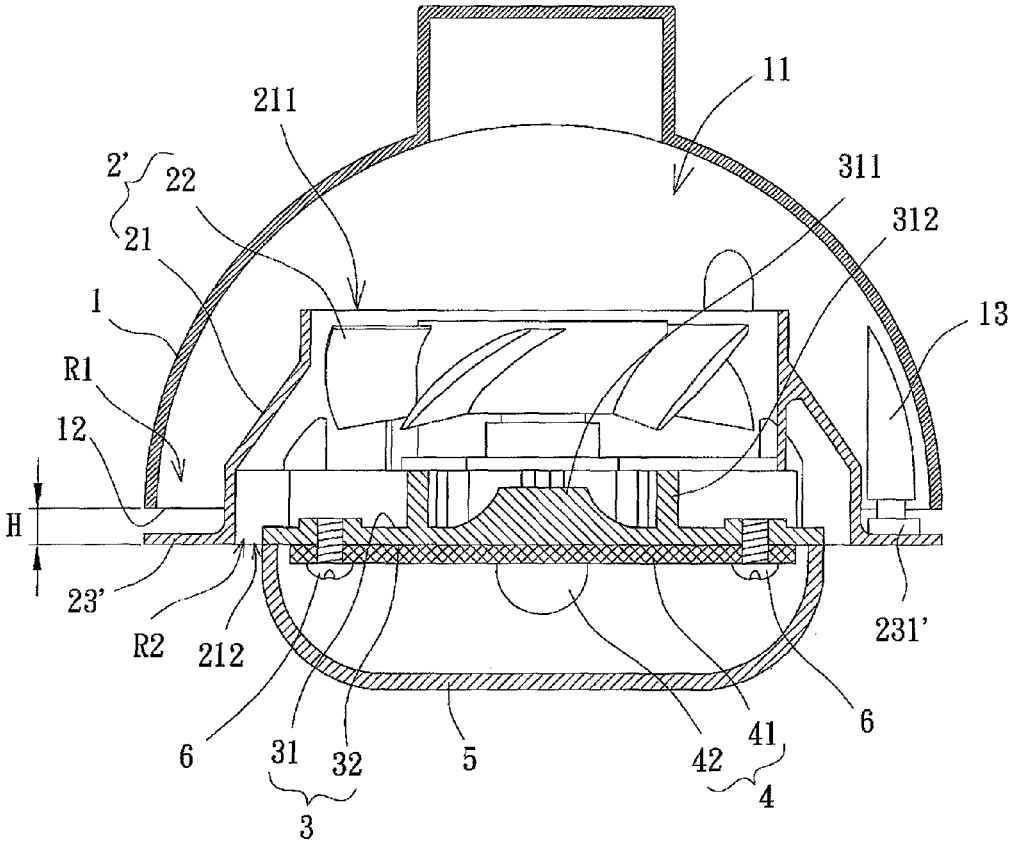
FIG. 5 is a cross-sectional view illustrating a lamp in accordance with a second embodiment of the present invention.

Referring to FIG. 5, according to a second embodiment of the present invention, a lamp also comprises a housing 1, a fan 2', a heat sink 3, a light emitting element 4 and a cover 5. Structures of the housing 1, the heat sink 3, the light emitting element 4 and the cover 5 of the second embodiment are all the same as those of the first embodiment, and whose unnecessary details will not be further described in the following paragraphs.

It is noted that the major difference between the fan 2' of the second embodiment and the fan of the first embodiments is that: the fan 2' does not have the assembled portion 213 of the first embodiment, but has instead a circumference of a second air passage 212 of a frame 21 and with the circumference of the second air passage 212 extending radially and outwards to form an extension 23'. The extension 23' has a plurality of connected portions 231', with each of the connected portions 213' facing each supporting element 13 and with the fixed elements 6 to couple the housing 1 with the frame 21.

The extension 23' of the fan 2' can conduct and adjust the direction of the air flow in a first air-guiding channel R1 to a radial direction of the fan 2' which is specifically different from the direction of the air flow in the second air passage 212 for avoiding backflows of heat air.

Figure 6:
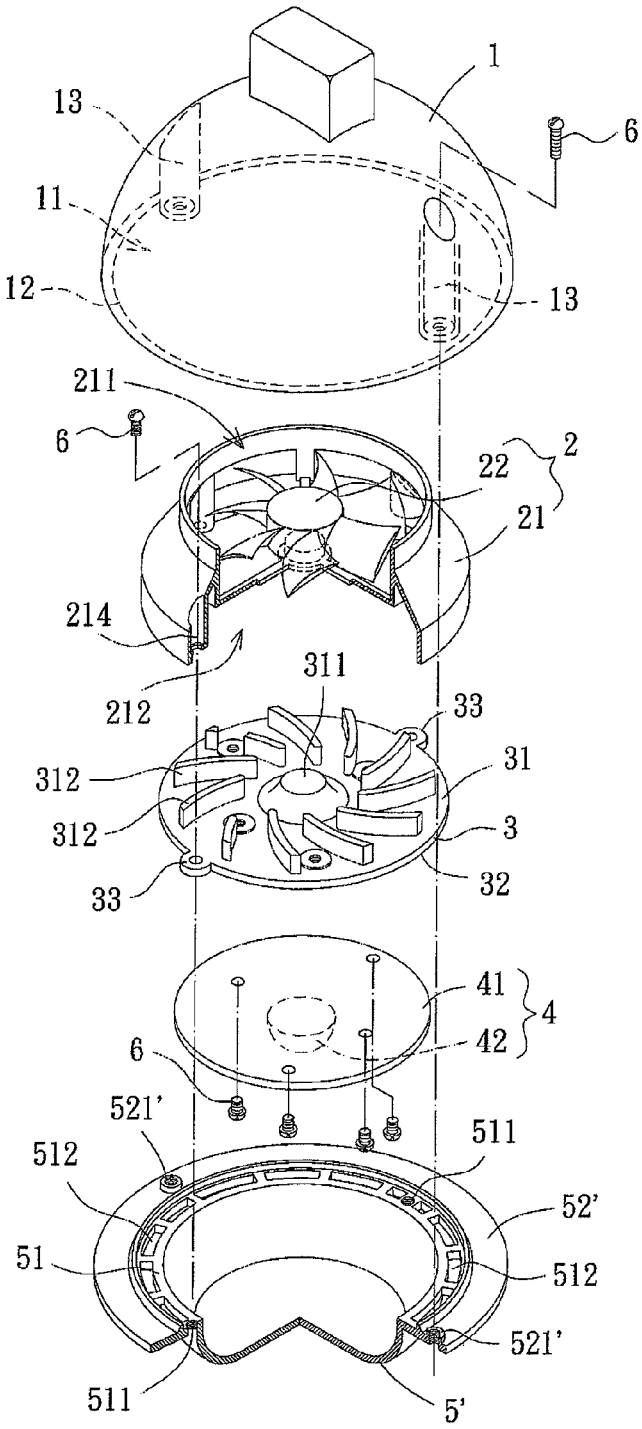
FIG. 6 shows an exploded diagram illustrating the lamp in accordance with a third embodiment of the present invention.
Figure 7:
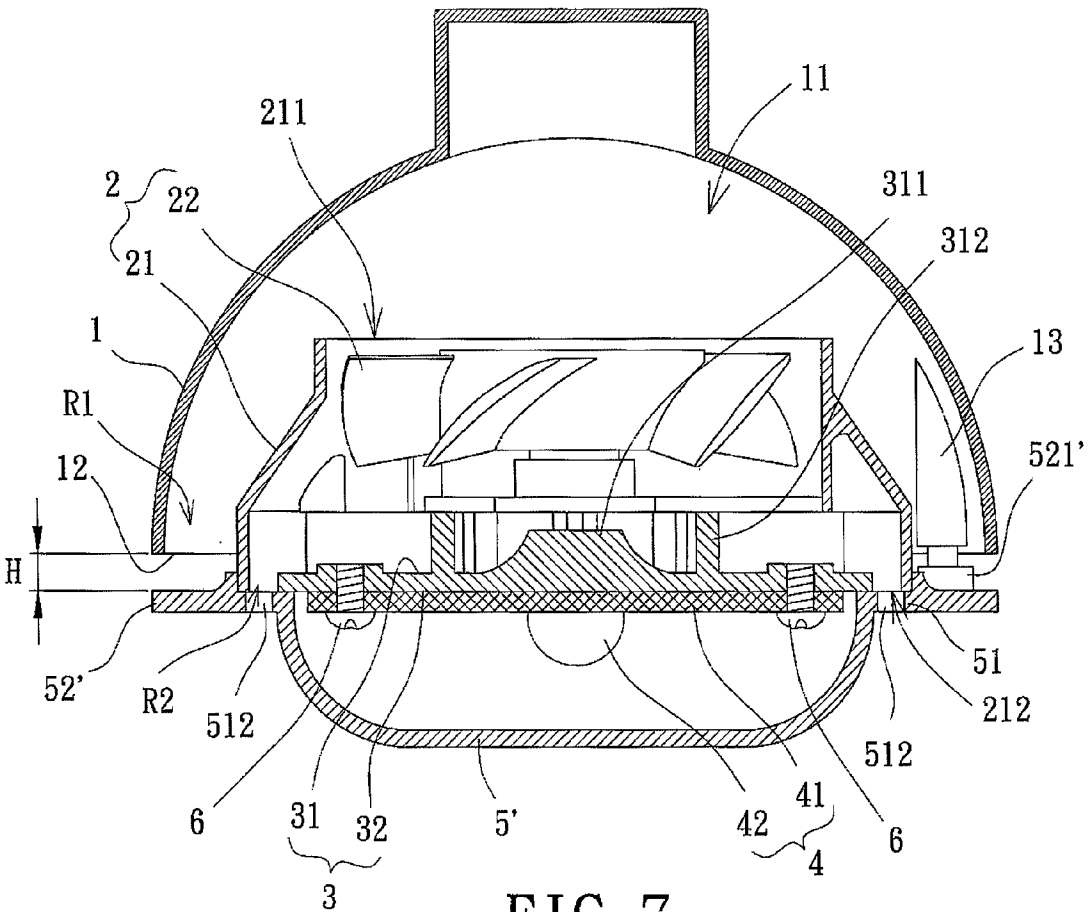
FIG. 7 shows a cross-sectional view illustrating the lamp in accordance with the third embodiment of the present invention.

With reference to FIGS. 6 and 7, a lamp of a third embodiment in the present invention is shown and also has a housing 1, a fan 2, a heat sink 3, a light emitting element 4 and a cover 5'.

The lamp of the present embodiment also has an extension, but the major difference between the second and third embodiments is characterized in that: the lamp of the third embodiment has a peripheral edge 51 of the cover 5', with the peripheral edge 51 extending outward to form an extension 52' rather than forming an extension at a frame 21 of the fan 2 as it is arranged in the second embodiment. The extension 52' has a plurality of connected portions 521', with each of the connected portions 521' facing each supporting element 13 of the housing 1, and with fixed elements 6 to couple the housing 1 with the cover 5'.

The extension 52' of the cover 5' can also conduct and adjust the direction of the air flow in a first air-guiding channel R1 so that the direction of the air flow in the first air-guiding channel R1 is different from that in a second air-guiding channels R2 for avoiding backflow of heat air. Moreover, since the extension 52' is extended from the cover 5', the structure of the frame 21 of the fan 2 can be simplified so as to be convenience in production.

Figure 8:
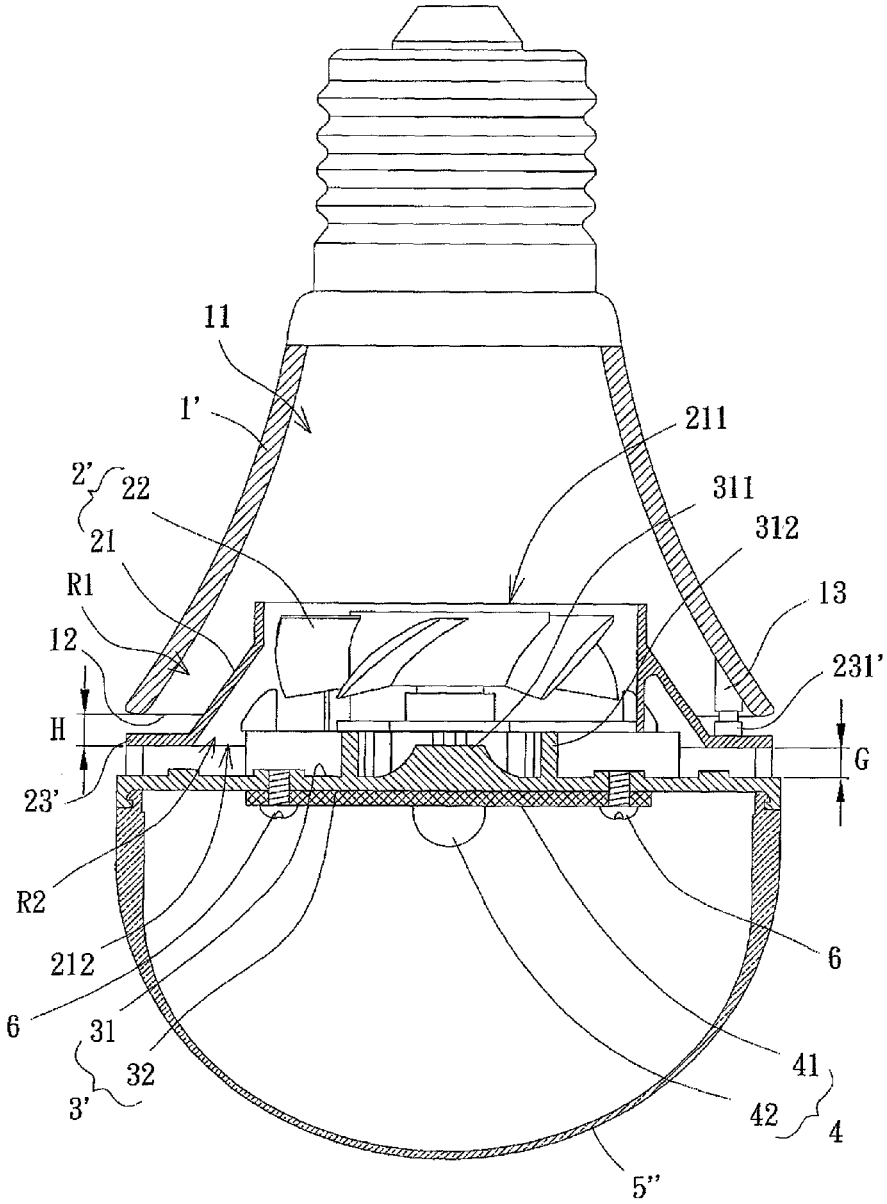
FIG. 8 shows a cross-sectional view illustrating the lamp in accordance with a forth embodiment of the present invention.

Referring to FIG. 8, a lamp of a fourth embodiment in the present invention comprises a housing 1', a fan 2', a heat sink 3', a light emitting element 4 and a cover 5". Structures of the housing 1', the fan 2', the light emitting element 4 and the cover 5" are approximately the same as those in the second embodiment but slightly different in their appearance and shape, and whose unnecessary details will not be further given in the following paragraphs.

The heat sink 3' of the fourth embodiment still has a second air-guiding channel R2 spaced form an inner peripheral surface of a frame 21 of the fan 2', but the primary difference between which and the heat sink 3 of the second embodiment is in that: the heat sink 3' has an outer periphery linking first and second surfaces 31, 32, with the outer periphery of the heat sink 3' extending outwards and being spaced from an extension 23' of the fan 2' to form a gap (G). Accordingly, the direction of the air flow in a second air guiding channel R2 can also be adjusted in a radial direction and capable of widely applying to any possible type of lamp. In addition, the cover 5" of the present embodiment is mounted to the second surface 32 of the heat sink 3' via a method of buckling.

Figure 9:
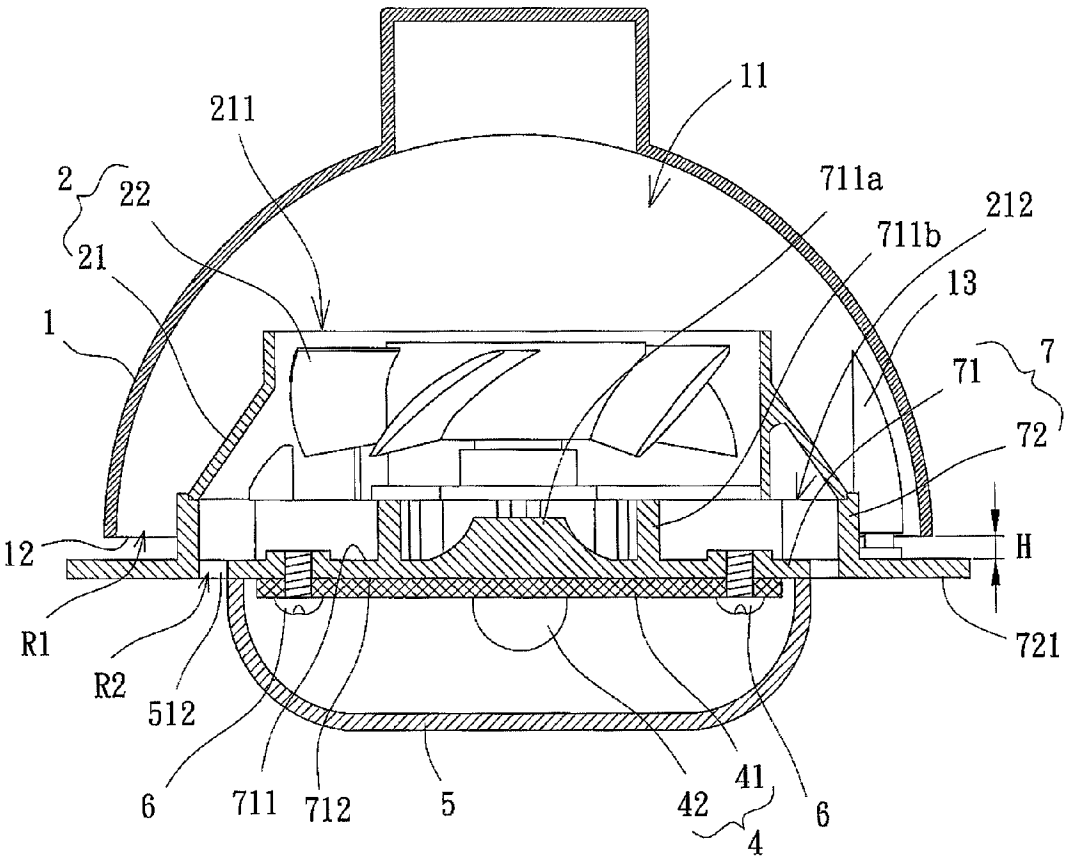
FIG. 9 shows a cross-sectional view illustrating the lamp in accordance with a fifth embodiment of the present invention.

Referring to FIG. 9, a lamp of a fifth embodiment in the present invention also comprises a housing 1, a fan 2, a heat sink 7, a light emitting element 4 and a cover 5, wherein structures of the housing 1, the fan 2, the light emitting element 4 and the cover 5 are all the same as those in the above first embodiment and whose unnecessary details will not be given further in the following paragraphs. The main difference between the heat sink 3 of the first embodiment and the heat sink 7 of the fifth embodiment is characterized in that:

The heat sink 7 has a substance 71 and an annular wall 72. The substance 71 has a first surface 711 and a second surface 712. The first surface 711 has a protrusion 711*a* and a plurality of fins 711*b* for increasing the heat-dissipated area of the substance 71. The annular wall 72 is disposed around the substance 71, with an inner peripheral surface of the annular wall 72 spacing from a peripheral edge of the substance 71 to form a second air-guiding channel R2. Ends of the second air-guiding channel R2 can protrude over an opening 12 of the housing 1. The heat sink 7 can further have plural ribs to connect the inner peripheral surface of the annular wall 72 and the peripheral edge of the substance 71 with each other.

A free end of the annular wall 72 of the heat sink 7 is adjacent to a bottom rim of a frame 21 of the fan 2 so that a second air passage 212 of the fan 2 and the second air-guiding channel R2 can communicate with each other. The first surface 711 of the heat sink 7 faces an impeller 22. The light emitting element 4 and the cover 5' are mounted to the second surface 712 respectively. A peripheral surface of the annular wall 72 of the heat sink 7 further extends outwards to form an extension 721 in a radial direction of the fan 2. The extension 721 can conduct and adjust the direction of inhaled or exhaled air of a first air-guiding channel R1, so that air can flow in or out by the first air-guiding channel R1 in a radial direction of fan 2 which is specifically different from the direction of inhaled or exhaled air by the second air passage 212 for avoiding backflows of heat air.

Figure 10:
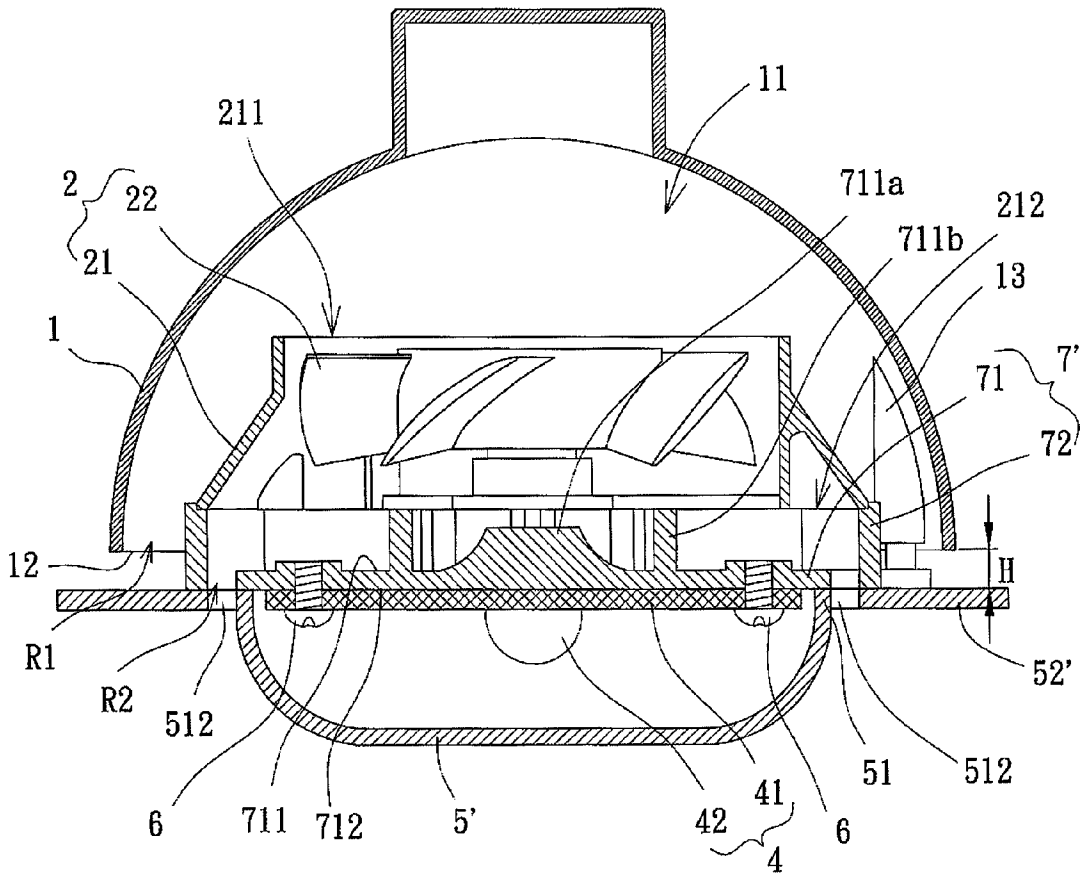
FIG. 10 shows a cross-sectional view illustrating the lamp in accordance with a sixth embodiment of the present invention.

With reference to FIG. 10, a lamp of a sixth embodiment in the present invention also comprises a housing 1, a fan 2, a heat sink 7', a light emitting element 4 and a cover 5'. The lamp of the six embodiment also has an extension and structures of the housing 1, the fan 2 and the light emitting element 4 of the sixth embodiment are all the same as those of the fifth embodiment. It is noticed that the main difference between the sixth and fifth embodiments is that: the cover 5' has a peripheral edge 51 which extends outward to form an extension 52' rather than forming an extension at an outer peripheral surface of an annular wall 72 of the heat sink 7' like it is arranged in the fifth embodiment. Furthermore, the peripheral edge 51 has a plurality of vents 512 facing a second air-guiding channel R2 for air circulation.

The extension 52' of the present embodiment also can conduct and adjust the direction of the air flow in a first air-guiding channel R1 so that the direction of the air flow in the first air-guiding channel R1 is different from that in the second air-guiding channels R2 for avoiding backflow of heat air. As a result, the structure of the heat sink 7' can be simplified so as to be convenience in production.

As it is described above, the lamp of the present invention has the first air-guiding channel R1 between the inner peripheral surface of the housing 1 and the peripheral surface of the frame 21 of fan 2 or 2', and the second air-guiding channel R2 between the inner peripheral surface of the frame 21 of the fan 2 or 2' and the outer periphery of the heat sink 3, 7 or 7'. Both of the first and second air-guiding channels R1, R2 can communicate with the compartment 11 of housing 1 so that air in the compartment 11 and air outside the housing 1 can circulate with each other via the first and second air-guiding channels R1, R2. Thus, the lamp of the present invention only needs a single and individual component of housing 1 for receiving the fan 2 or 2', the heat sink 3, 7 or 7' and the light emitting 4. In additional, it has no necessity for any arrangement of air inlets or outlets, so as to be less complexity in structure and more convenient in manufacture and assemblage.

In practical use of the present invention in any type of lamp, arts of the present invention can provide effective cooling effect, even for lamps that inbuilt into the false ceiling, because the first and second air-guiding channels R1, R2 will remain beneath the bottom surface of the ceiling for smooth air-circulation with external air. Therefore, high efficiency of heat dissipation as well as extension of surface life of lamp can both be achieved.

Thus, since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A lamp comprising:

a housing, having a compartment with an opening;

a fan, disposed inside the compartment of the housing, and having an impeller mounted inside a frame, with a first air-guiding channel formed between a peripheral surface of the frame and an inner peripheral surface of the housing;

a heat sink, coupled to the fan and having a first surface and a second surface, with the first surface facing the impeller and with an outer periphery of the heat sink being spaced from an inner peripheral surface of the frame to form a second air-guiding channel;

a light emitting element, disposed on the second surface of the heat sink, wherein the frame of the fan has a first air passage and a second air passage communicated with each other, with the impeller mounted between the first air passage and the second air passage, with the first air passage disposed inside the compartment of the housing, with the heat sink mounted across the second air passage, and with the second air passage being arranged out of the opening of the housing.

2. The lamp as defined in claim 1, with a circumference of the second air passage of the frame extending radially and outwards to form an extension.

3. The lamp as defined in claim 1, further comprising a cover mounted to the second surface of the heat sink to cover the light emitting element.

4. The lamp as defined in claim 3, wherein a peripheral edge of the cover has a plurality of vents in correspondence with the second air-guiding channel.

5. The lamp as defined in claim 4, with the peripheral edge of the cover further extending outwards to form an extension.

6. The lamp as defined in claim 2, with the outer periphery of the heat sink being spaced from the extension to form a gap.

7. The lamp as defined in claim 1, with the first surface of the heat sink having a protrusion and a plurality of cooling fins.

8. A lamp comprising:

a housing, having a compartment with a opening;

a fan, disposed inside the compartment of the housing, having an impeller mounted inside a frame, with a first air-guiding channel formed between a peripheral surface of the frame and an inner peripheral surface of the housing;

a heat sink, having a substance with a first surface and a second surface, and mounted inside an annular wall, with an inner peripheral surface of the annular wall spacing from a peripheral edge of the substance to form a second air-guiding channel, with a free end of the annular wall adjacent to a bottom rim of the frame of the fan, with the first surface of the substance facing the impeller, and with an outer peripheral surface of the annular wall of the heat sink extending radially and outwards to form an extension;

a light emitting element, disposed on the second surface of the heat sink, wherein the frame of fan has a first air passage and a second air passage communicated with each other, with the impeller mounted between the first air passage and the second air passage, with the first air passage disposed inside the compartment of the housing, with the second air passage communicating with the second air-guiding channel, and with ends of the second air-guiding channel protruding over the opening of the housing.

9. The lamp as defined in claim 8, further comprising a cover disposed on the second surface of the heat sink to cover the light emitting element.

10. The lamp as defined in claim 8, with the first surface of the heat sink having a protrusion and a plurality of cooling fins.

* * * * *